United States Patent [19]

Bealer

[11] Patent Number: 4,751,883

[45] Date of Patent: Jun. 21, 1988

[54] RAILWAY CAR FOR TRANSPORT OF GRAIN OR AUTOMOBILES

[76] Inventor: Robert W. Bealer, Box 58, Group 11, R.R. #1C, Winnipeg, Manitoba, Canada, R3C 2E4

[21] Appl. No.: 927,871

[22] Filed: Nov. 7, 1986

Related U.S. Application Data

[63] Continuation-in-part of Ser. No. 755,736, Jul. 17, 1985, abandoned.

[51] Int. Cl.[4] ..... B61D 3/18; B61D 7/00; B60P 3/08

[52] U.S. Cl. ..... 105/238.1; 105/243; 105/359; 410/24

[58] Field of Search ..... 105/243, 359, 370–372, 105/343, 422, 280, 282.2, 406.2, 424, 238.1; 410/24, 26

[56] References Cited

U.S. PATENT DOCUMENTS

| | | | |
|---|---|---|---|
| 3,503,340 | 3/1970 | Warren | 410/24 |
| 3,595,175 | 7/1971 | Austill | 105/243 |
| 3,692,363 | 9/1972 | Tenebaum et al. | 105/243 X |
| 3,901,552 | 8/1975 | Stone | 105/243 X |
| 4,084,516 | 4/1978 | Ravani et al. | 410/26 |
| 4,092,051 | 5/1978 | D'Orazio | 105/243 X |
| 4,094,546 | 6/1978 | Glassmeyer et al. | 410/26 X |
| 4,221,427 | 9/1980 | Sentle, Jr. et al. | 105/243 X |
| 4,437,410 | 3/1984 | Stoller, Sr. et al. | 410/26 X |

FOREIGN PATENT DOCUMENTS

| | | | |
|---|---|---|---|
| 527696 | 7/1956 | Canada | 410/241 |

*Primary Examiner*—Robert B. Reeves
*Assistant Examiner*—Frank Williams
*Attorney, Agent, or Firm*—Stanley G. Ade; Adrian D. Battison; Murray E. Thrift

[57] ABSTRACT

A railway car is convertible from a grain carrying car to a vehicle transport car and vice-versa. The car has closed sides, a roof and a floor and end doors movable from a closed position when in the grain carrying mode and to an open position for vehicle transport mode. Loading hatches in the roof and dumping hoppers in the base allow for use in carrying grain and other comminuted material and longitudinally extending spaced and parallel vehicle grids are provided on one, two or three levels thereby permitting vehicles to be carried in a conventional manner when in the vehicle transport mode. The grids and supporting structure permit and facilitate the loading and unloading of grain or the like when in the grain carrying mode and the railway car is easily converted manually from one mode to the other.

12 Claims, 2 Drawing Sheets

RAILWAY CAR FOR TRANSPORT OF GRAIN OR AUTOMOBILES

This application is a continuation-in-part of U.S. application Ser. No. 755,736, abandoned, filed July 17,1985.

BACKGROUND OF THE INVENTION

This invention relates to new and useful improvements in railway cars which can readily be converted so that they can be used either for the transportation of vehicles such as automobiles and trucks and the like or the transportation of grain or other comminuted material in bulk.

Conventionally, railway cars that are used for grain usually travel empty on the return trip and especially designed cars for the transportation of automobiles and trucks also travel empty on the return trip.

In Canada and the United States, for example, grain is usually being transported from inland and the centre of the country, to the seacoast and by contrast, automobiles and trucks are often transported from the seacoast either inland or across the country so that it will be apparent that if a combination railroad car could be used which would transport grain or other similar material to the ports and automobiles and trucks on the return trip, a considerable saving in costs would result. It is apparent, of course, that only a percentage of cars could be used for double cargos, but it is believed that, with some careful scheduling, a relatively large majority of dual use cars could be utilized.

SUMMARY OF THE INYENTION

For the transportation of automobiles and trucks, the object is to provide a railway car that is loaded by "circus loading" whereby a series of very similar railway cars hooked together, are loaded by driving the automobiles or trucks onto the three levels of the first railway car and then driving the cars through each railway car until the last railway car in the series is reached and all levels of all the railway cars are filled. A series of two-level railway cars would be "circus-loaded" in a similar manner with an appropriate number of pick-up trucks and vans (which are higher than automobiles). These three-level and two-level railway cars would have "industry-standard" flip-up auto-loading ramps which bridge between the railway cars and would make these railway cars compatible with existing "auto rack" railway cars.

An advantage is to have a flat automobile track for "circus loading" so as to allow the speed of loading that is currently customary.

On the other hand, for the transportation of grain and other comminuted material in bulk, the object is to have "top loading" whereby the grain or comminuted material is loaded through roof hatches and "bottom unloading" whereby the grain is unloaded by opening chutes in the bottom of the railway car, usually over floor grates at terminal elevators.

Another advantage of the present device is to have optimized sealing of the end doors, which is enhanced by having the doors open inwardly. Thus, with the doors closed, the weight of the grain within the car creates pressure to increase the sealing of the doors.

For the converting of a railway car from one mode to the other mode, the object is to provide a car that can be converted quickly by one operator without the necessity of powered assistance. A simple hand tool in the form of a handle with a hook at the end would save the operator bending over to slide the "sliding section" of the auto track into or out of position.

One aspect of the invention is to provide, in a railway car, for use in a grain or other comminuted material mode and in a vehicle transport mode, said car including longitudinally extending closed sides, a lower floor and a roof, and rail engaging trucks and wheels both interacting to support said car, said car comprising in combination at least one material loading hatch in the roof thereof, at least one material unloading hopper in the floor thereof, a pair of spaced and parallel vehicle tracks supported upon said floor whereby said grain and other comminuted material may flow through said tracks to said hopper therebelow, vertically situated single doors spaced inwardly from the ends of said car movable in a horizontal arc from a closed, material carrying position when in the material carrying mode, inwardly to an open position adjacent one side wall of said car when in the vehicle transport mode and vice-versa, a door frame for each door spanning said car, door seals around the inner sides of said frames engageable by the outer ends of said doors when said doors are in the closed position thereby sealing said doors, and hence the entire ends of said car, the pressure of the associated grain or other comminuted material against said doors enhancing the sealing of said doors with said frames, the car defined by said doors when closed, having a usable, available volume substantially less than when said doors are open.

Another aspect of the invention is to provide a combination railway car which is easily convertible manually from one mode to the other and in which the structure for vehicle transport does not interfere with the storage, loading or unloading of the grain or other comminuted material when in the grain carrying mode.

A further advantage of the invention is to provide a device of the character herewithin described which is relatively simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
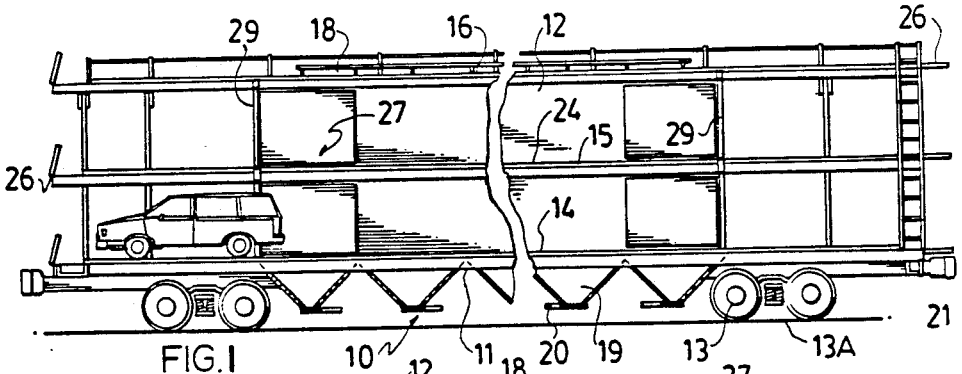
FIG. 1 is a longitudinal section of a three-level railway car showing automobiles therein.
Figure 2:
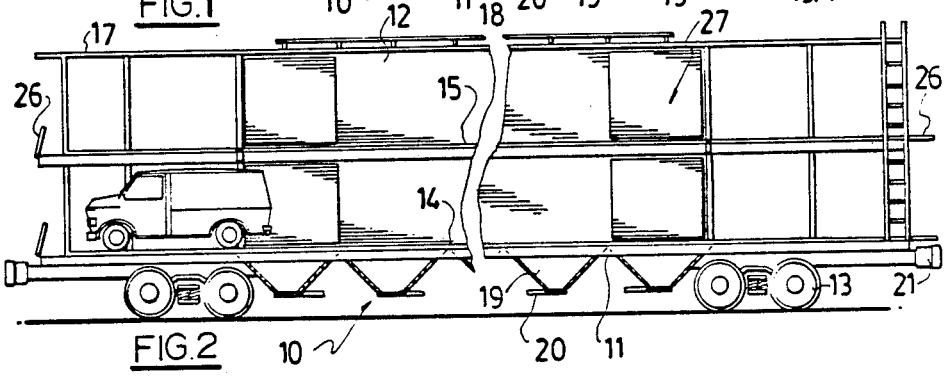
FIG. 2 is a longitudinal section of a two-level car showing vans and an automobile therein.

Proceeding therefore to describe the invention in detail, reference should first be made to FIGS. 1 and 2 which are similar with the exception that FIG. 1 shows a three-level car and FIG. 2 a two-level car.

The railway car collectively designated 10 is of conventional construction and includes internal frames and a base 11 and enclosed sides 12 and is mounted on conventional wheeled trucks or bogies 13 for running engagement with railroad tracks indicated schematically at 13A.

A floor 14 is provided spanning the car 10 together with an intermediate floor 15 and, in the case of FIG. 1, an upper floor 16 which is adapted to receive vehicles such as cars or trucks as clearly shown. The term "vehicle " is used to include wheeled or tracked vehicles which can be transported in this type of railroad car.

FIG. 2 is shown with the floor 14, the intermediate floor 15 and a conventional roof structure 17 which is provided with conventional grain loading hatches 18 therein as is the upper floor 16 of FIG. 1.

The floor or base 14 of both embodiments is provided with a plurality of conventional discharge hoppers 19 selectively sealed by conventional gates 20 and the ends of the cars are provided with conventional couplers 21.

On each of the floors adapted to receive automobiles, trucks or vans, a plurality of spaced and parallel automobile track support members 22 are provided spanning and extending transversely between the sides 12 of the railway car and these support members support a pair of spaced and parallel longitudinally extending automobile tracks collectively designated 23, one adjacent each side wall 12. These tracks are in the form of heavy gratings and may be provided with longitudinally extending upstanding guards 24 to guide the wheels of the automobiles along the auto tracks when they are being loaded and unloaded from the railway cars.

Spaced slightly below and underneath each of these tracks 23 and spanning the floors of the car, is a light grating 25 for safety reasons.

It will be noted that the two sets of gratings 23 and 25 will permit grain or comminuted material to pass downwardly therethrough and that the members 22 and guards 24 are preferably shaped to shed grain or comminuted material so that none of this material lodges or is retained within the railway car after unloading through the chutes 19. A triangular cross section is shown but of course other material shedding configurations may be used.

At the end of each of the auto tracks and exteriorly of the railway car, there is provided conventional flip-up auto loading ramps 26 and these span between adjacent cars when in the downward position so that automobiles or vans can be driven from one car to another as will hereinafter be explained.

For this reason, railways cars designed for the transportation of cars, trucks and the like are considerably longer than cars designed to transport grain. This is because cars, trucks and the like have less weight per unit volume than grain which is relatively dense and heavy and is usually preferably vertically situated in cars having shorter wheel bases than car and truck transport railway cars.

Figure 3:
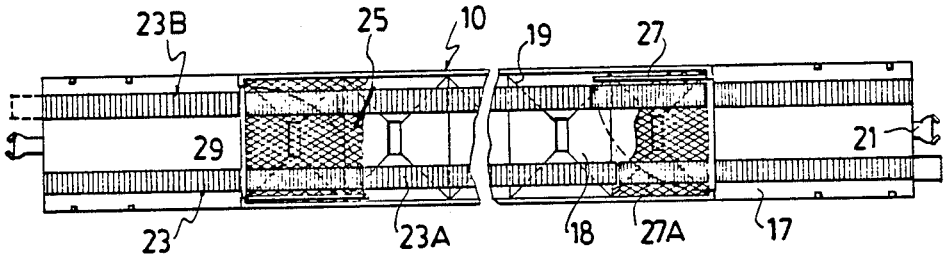
FIG. 3 is a top plan view partially in section of FIGS. 1 and 2.
Figure 4:
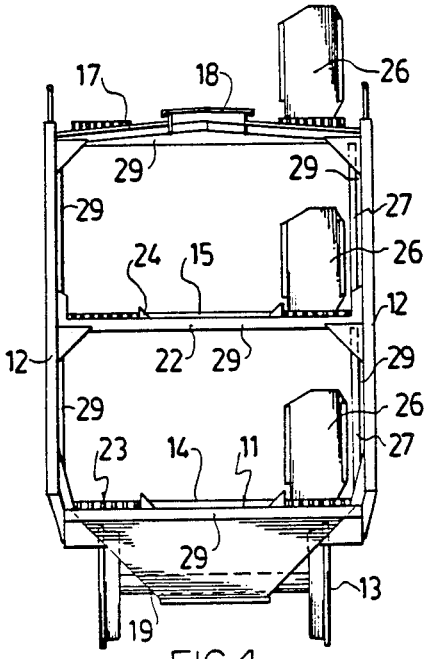
FIG. 4 is a transverse section of FIG. 1.
Figure 5:
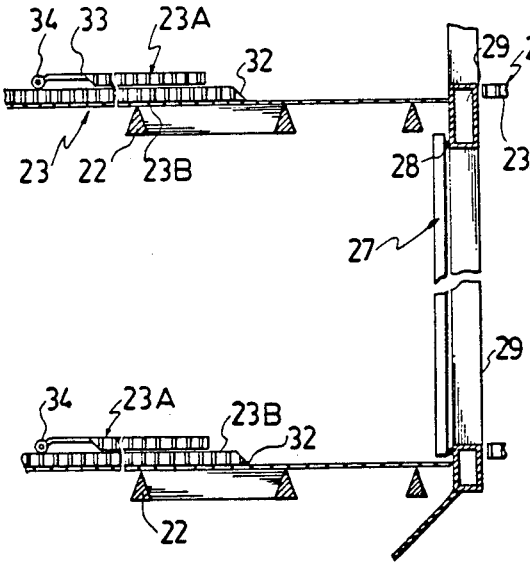
FIG. 5 is a partially schematic sectional view of one end of the car in FIG. 2 with the bulkhead door in the closed position for transporting the grain or other comminuted material.
Figure 6:
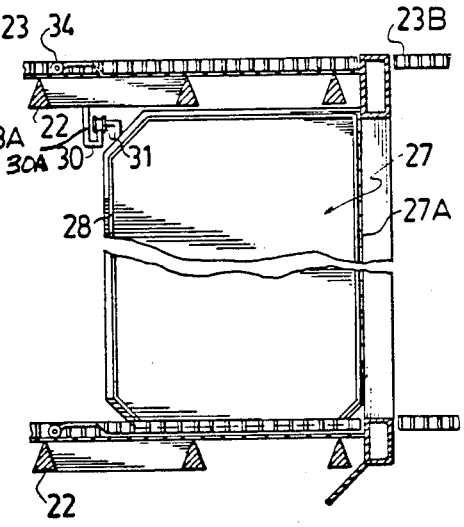
FIG. 6 is a view similar to FIG. 5 but showing the bulkhead door in the open position for transporting automobiles.

End doors collectively designated 27 are provided on each level adjacent to, but spaced inwardly from, the ends of the railway car and these doors are hinged by one vertical edge as at 27A to adjacent one of the bulkheads of the railway car and can be swung from a position in which the end portions of the car is closed off as shown in FIG. 5, to an open position against the side wall 15 as shown in FIGS. 3 and 6. When the door is closed, door seals 28 are provided between all four edges of the door on the outer side thereof, and the bulkhead members 29 thus providing a continuous seal. This means that pressure against the inside of the doors caused by the weight of grain thereagainst, assists in the sealing action between the doors and the bulkhead seals. In order to support the weight of the door, particularly when being moved from one position to the other, an arcuately curved rail 30 is provided onto which wheels 31 engage and these wheels are secured to the upper free corner of the door to support the door during the opening and closing movement thereof. It should be understood that the rail 30 is arcuately curved to follow the arc swept by the wheels as the door is moved from one position to the other and may be supported from the upper floor 16 or roof 17 by means of hangers 30A.

Because of the width of the doors 27 and the requirement that they swing across the car and seal from the inside, it will be appreciated that means are required in order to move the auto track end portions inwardly when the doors are required to be closed, in order to give sufficient clearance for this operation.

The end sections of the auto tracks collectively designated 23A are therefore movable from an extended or normal position shown in FIGS. 1, 2, 3 and 6 to a stored position shown in FIG. 5. The ends of the fixed or central portions of the auto tracks 23B are provided with ramps 32 and the inner ends 33 of the movable portions 23A are provided with small wheels 34.

When in the extended position shown in FIG. 6, the fixed central portion 23B and the two extended end portions 23A form a substantially continuous track.

When it is desired to move these tracks inwardly so that the door may be closed as shown in FIG. 5, the outer ends of the movable portions 23A are lifted slightly preferably by means of a tool which consists of a handle and a hook, and are then moved inwardly manually to overlie upon the portion of the fixed track 23B, this movement being facilitated by the wheels 34 rolling along the fixed track 23B.

The length of the movable sections combined is less than the length of the fixed section 23B so that there is plenty of room to store these portions in the position shown in FIG. 5 thus giving sufficient clearance for the door 27 to be moved from the stored position shown in FIG. 5 and vice-versa.

When the doors are in the closed position shown in FIG. 5, the railway car is in condition to receive grain or other comminuted material and when the doors are in the open position shown in FIG. 6, the railway car is in condition to receive automobiles, vans or trucks.

OPERATION OF THE INYENTION

To convert an empty railway car from transporting three levels of automobiles to transporting grain, the following steps are executed by the operator starting from one end of the railway car:

1. On the lower level of the three levels, unlatch one "sliding section" of auto track 23A, lift it upward at the outer end and slide it inwardly towards the transverse centre of the railway car to overlie the fixed section 23B. To ease this operation, the sliding section rests on the two wheels 34 at the inboard end thereof so that when the outboard end is lifted, the sliding section rolls on these wheels for this operation.

2. The other or parallel "sliding section" of auto track on the same level and at the same end is also unlatched and moved towards the centre of the railway car to make room for this particular end door to swing shut. The "sliding section" of auto track nearer the end door, when open, is longer than the other sliding section, as maximum clearance is required to initiate door closing, decreasing as the door edge approaches the closed position.

3. The end door, at this level, is unlatched from the side wall of the railway car and is swung towards the end of the car. The effort for this step is minimized by the fact that the door is supported by the trolley 31 on the rail 30.

4. The end door is sealed by engaging conventional pressure latches on the outside of the bulkhead (not illustrated).

5. On the second level at the same end of the railway car, the "sliding sections" are moved inwardly and the door is closed and sealed. The tracks on the third or upper level have no sliding section to move as there is no door to close.

6. The operator walks to the other end of the railway car checking as he goes that each of the unloading chutes 19 is closed and latched.

7. At the other end of the railway car, the pairs of "sliding sections" are moved inwardly and the relevant end doors are closed and sealed. The car is now ready for loading and the loading chutes in the roof of the railway car are opened only at the time of actual grain or other material loading and then are closed and latched, and are only re-opened when the next loading takes place. When in position for unloading the grain or other material, the gates 20 are opened in chutes 19 and the material flows through the grates 23 and 25 to the hopper so that the car is emptied completely and rapidly.

8. To convert from transporting grain to transporting automobiles or trucks, the reverse sequence is follows, namely closing the hoppers 19, opening the end doors, sliding the "sliding sections" into the extended position and opening or flipping down the auto loading ramps.

The same sequence is, of course, followed for the two-level railway car shown in FIG. 2.

It will therefore be seen that a dual use railway car is provided which is readily converted from one use to the other by one operator and without the necessity of using power equipment of any kind. Furthermore, because of the grates provided, the unloading of grain or comminuted material is not restricted by the "floors" which are used to support automobiles or trucks when in the other mode.

Since various modifications can be made in my invention as herein described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A railway car comprising in combination a pair of closed side walls, a lower floor, a roof and a rail engaging trucks and wheels both interacting for supporting said car, and means to change said car from a grain and comminuted material carrying mode to a vehicle transport mode and vice versa, said means including at least one material loading hatch in the roof thereof and at least one material unloading hopper in the lower floor thereof, a pair of spaced and parallel vehicle tracks supported upon said lower floor whereby said grain and other comminuted material may flow past said tracks to said hoper therebelow, vertically situated single doors spaced from the ends of said car, each door being movable in a horizontal arc between between a closed position extending across the car, between the side walls, and an open position adjacent one side wall of said car, the doors being in their closed positions when the car is in the material carrying mode and in their open position when the car is in the vehicle transport mode, a door frame for each door spanning said car, door seals around the inner side of said frames engageable by the outer edges of said doors when said doors are in the closed position thereby sealing said doors, and hence the entire ends of said car, the pressure of the associated grain or other comminuted material against said doors enhancing the sealing of said doors with said frames, at least one intermediate floor spaced above said lower floor thereby defining a lower vehicle storage level and an intermediate vehicle storage level, said intermediate floor including a pair of spaced and parallel vehicle tracks supported above said lower floor whereby said grain and other comminuted material may flow past said tracks on said intermediate and lower floors to said hopper therebelow, further vertically situated single doors on said intermediate level spaced inwardly from the ends of said car, each movable in a horizontal arc between a closed, position extending across the car, between the side walls, inwardly and an open position adjacent one side wall of said car, the doors being in their closed positions when the car is in hte material carrying mode and in their open positions when the car is in the vehicle transport mode, a door frame for each further door spanning said car, door seals around the inner side of said frames engageable by the outer edges of said further doors when said further doors are in the closed position thereby sealing said further doors, and hence the entire ends of said car, the pressure of the associated grain or other comminuted material against said further doors enhancing the sealing of said further doors with said frames.

2. The car according to claim 1 in which each said door is hinged by one edge thereof to the adjacent side wall of said car for movement in a horizontal plane, a roller adjacent the outer upper corner of said door, an arcuately curved track supported from said car and engageable by said roller to facilitate the movement of said door from the open position to the closed position and vice-versa.

3. The railway car according to claim 1 which includes means to support said vehicle tracks on said lower and intermediate levels, said means spanning said car between said side walls thereof in spaced and parallel relationship from one another, said means being configured to shed grain or comminuted material, a safety grate spanning said floor between said vehicle tracks and said means to support said vehicle tracks, and side guards along the inner edges of said vehicle tracks and extending upwardly therefrom, to retain the wheels of said vehicles on said vehicle tracks when being driven along said tracks, said side guards also being configured to shed grain or comminuted material.

4. The railway car according to claim 1 which includes vehicle ramps on the ends of each said car adjacent the level of each of said vehicle tracks, each said ramp being movable from an upper storage position to a lower transport position, said ramps, when in the vehicle transport position, extending between the ends of the tracks of adjacently coupled cars whereby vehicle may be driven along said tracks from one car to another.

5. The railway car according to claim 1 which includes a further floor on the roof of said car, said further floor including a pair of spaced and parallel vehicle tracks supported upon said roof.

6. The car according to claim 1 in which each of said vehicle tracks includes an end section at each end, which end section is selectively movable whereby to permit said end doors to swing from one position to the other.

7. The railway car according to claim 6 including hinge means hanging each door to one of the side walls and in which the end sections of the tracks adjacent the hinge means are longer in length than the end section of the tracks remote from the hinge means.

8. The car according to claim 6 in which each vehicle track includes a fixed centre section and movable end sections at opposite, outer ends of the centre section, said centre section having ramps on the outer ends thereof, and said end sections each including a pair of relatively small wheels on an inner end thereof, the wheels being engageable with said ramps thereby to facilitate the endwise sliding movement of said end sections upon said centre section between an extended vehicle loading position when the car is in the vehicle transport mode and a retracted position overlying said centre section when the car is in the material carrying mode.

9. The car according to claim 8 in which the sum of the lengths of the two end sections of each track is less than the length of said centre section thereof whereby said end sections can be stored on said centre section and within the confines of said centre section whereby said doors can be moved from said open position to said closed position and vice-versa, said vehicle tracks taking the form of relatively heavy duty, longitudinally extending spaced and parallel grates.

10. The car according to claim 8 in which each said door is hinged by one end thereof to the adjacent side wall of said car for movement in a horizontal plane, a roller adjacent the outer upper corner of said door, an arcuately curved track supported from said car engageable by said roller to facilitate the movement of said door from the open position to the closed position and vice-versa.

11. The railway car according to claim 8 which includes means to support said vehicle tracks on said lower and intermediate levels, said means spanning said car between said side walls thereof in spaced and parallel relationship from one another, said means being configured to shed grain or comminuted material, a safety grate spanning said floor between said vehicle tracks and said means to support said vehicle tracks, and side guards along the inner edges of said vehicle tracks and extending upwardly therefrom, to retain the wheels of said vehicles on said vehicle tracks when being driven along said tracks, said side guards also being configured to shed grain or comminuted material.

12. The railway car according to claim 8 including hinge means hanging each door to one of the side walls and in which the end sections of the tracks adjacent the hinge means are longer in length than the end sections of the tracks remote from the hinge means.

* * * * *